US007017221B1

(12) United States Patent
Grey et al.

(10) Patent No.: US 7,017,221 B1
(45) Date of Patent: Mar. 28, 2006

(54) FLOOR SWEEPING APPARATUS

(75) Inventors: Nicholas Gerald Grey, Crowle (GB); Graham Robert Sentance, St. Johns (GB)

(73) Assignee: Techtronic Industries Company Limited, Tsuen Wan (HK)

( * ) Notice: Subject to any disclaimer, the term of this patent is extended or adjusted under 35 U.S.C. 154(b) by 463 days.

(21) Appl. No.: 10/129,409

(22) PCT Filed: Nov. 3, 2000

(86) PCT No.: PCT/GB00/04244

§ 371 (c)(1),
(2), (4) Date: Aug. 9, 2002

(87) PCT Pub. No.: WO01/32065

PCT Pub. Date: May 10, 2001

(30) Foreign Application Priority Data

Nov. 4, 1999 (GB) ..... 9926008

(51) Int. Cl.
*A47L 5/30* (2006.01)
*A47L 9/04* (2006.01)

(52) U.S. Cl. ..... 15/41.1; 15/42; 15/383

(58) Field of Classification Search ..... 15/41.1, 15/42, 383
See application file for complete search history.

(56) References Cited

U.S. PATENT DOCUMENTS 3,744,077 A * 7/1973 Smyth ..... 15/41.1
4,219,902 A * 9/1980 DeMaagd ..... 15/364

FOREIGN PATENT DOCUMENTS

| | | |
|---|---|---|
| DE | 30 39 167 A1 | 5/1982 |
| DE | 32 29 786 A1 | 2/1984 |
| EP | 0 285 096 A2 | 10/1988 |

OTHER PUBLICATIONS

Patent Abstract of Japan vol. 016, No. 202 (C-0940), JP 04 035632, Feb. 6, 1992.

* cited by examiner

*Primary Examiner*—Randall Chin
(74) *Attorney, Agent, or Firm*—Venable; Robert Kinberg; Steven J. Schwarz

(57) ABSTRACT

Floor sweeping apparatus (9) of the type having a rotary brush member (20), which in use is driven to rotate about a generally horizontal axis, the brush member (20) having bristle elements (22) that, as the brush member (20) rotates, extend during part of their range of movement through an aperture (13) in a base plate (12) of a housing (10) in which the rotary brush member (20) is rotatably journalled has at least one bristle element (22), hereinafter called an end-most bristle element (25), arranged immediately adjacent to each end of said brush member (20), and a deflector member (26) is provided at each end of the aperture (13) to co-operate with said end-most bristle element (25) at the respective end of the brush member (20). The deflector members (26) deflect said end-most bristle elements (25) axially beyond the end of the aperture (13) as said end-most bristle elements (25) extend through the aperture (13) during the rotation of the brush member (20) to effectively extend the sweeping action at least up to, and preferably beyond, the outer edge of the housing.

12 Claims, 3 Drawing Sheets

FIG 1
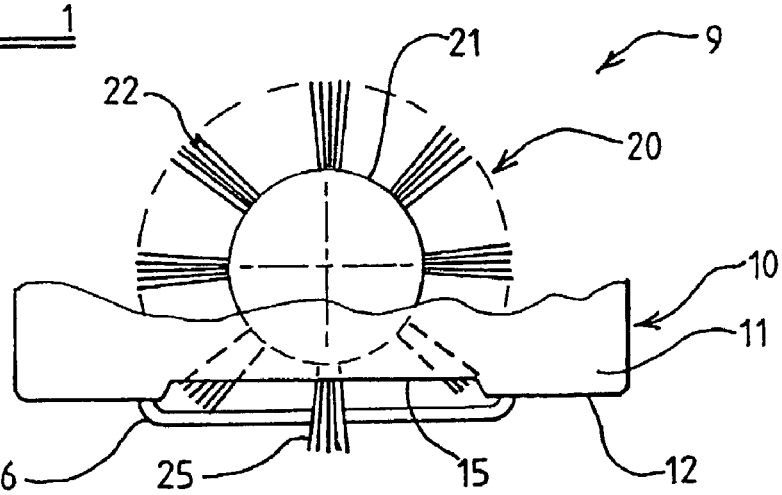
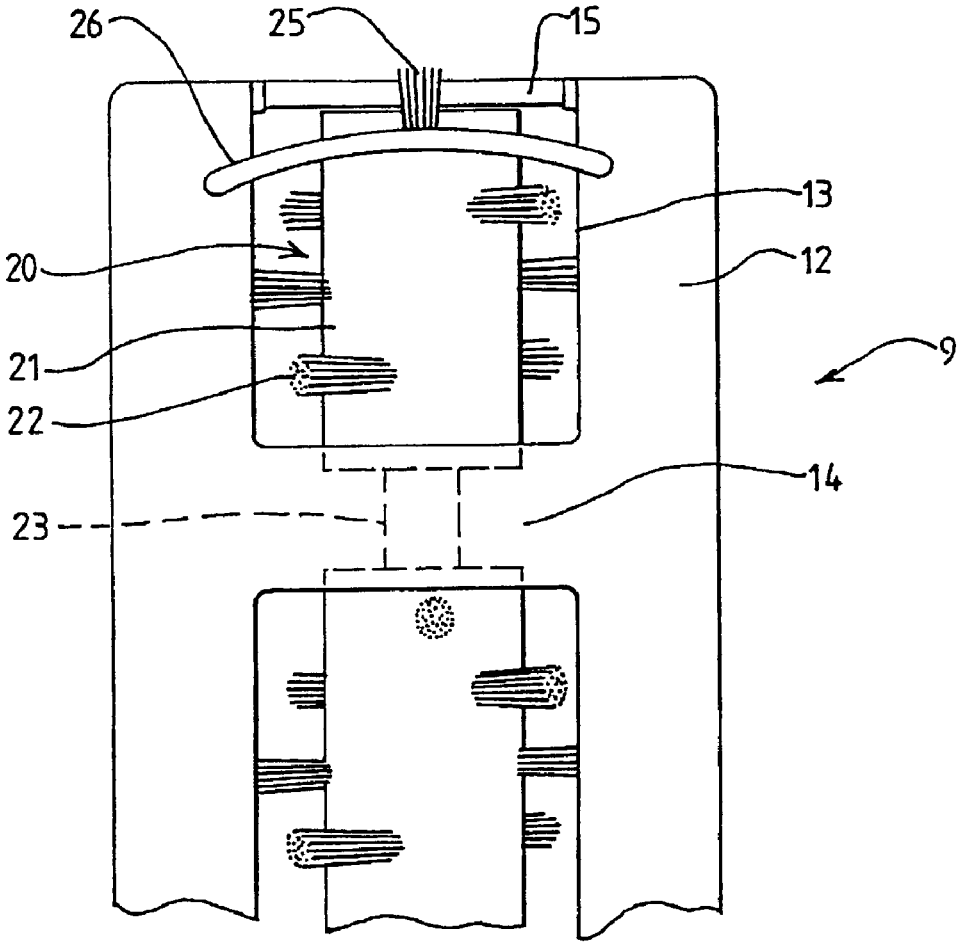
FIG 2

FIG 5
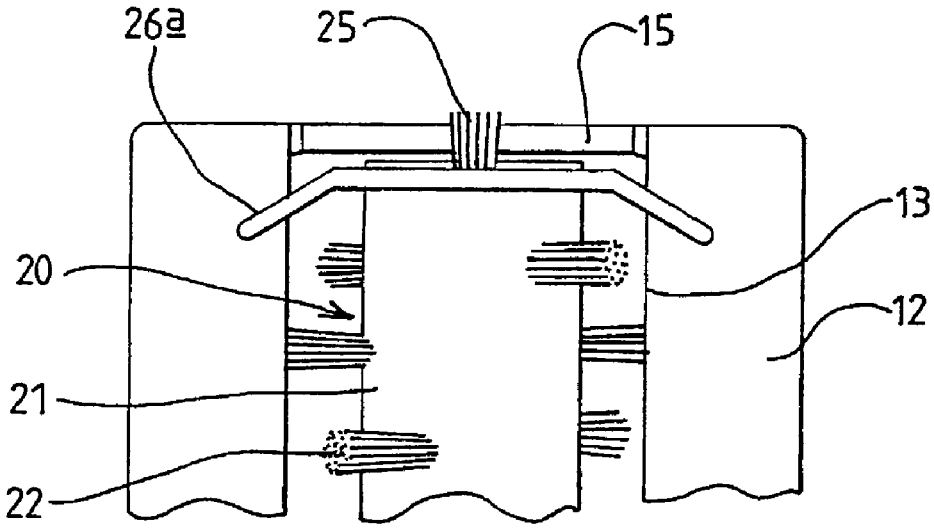
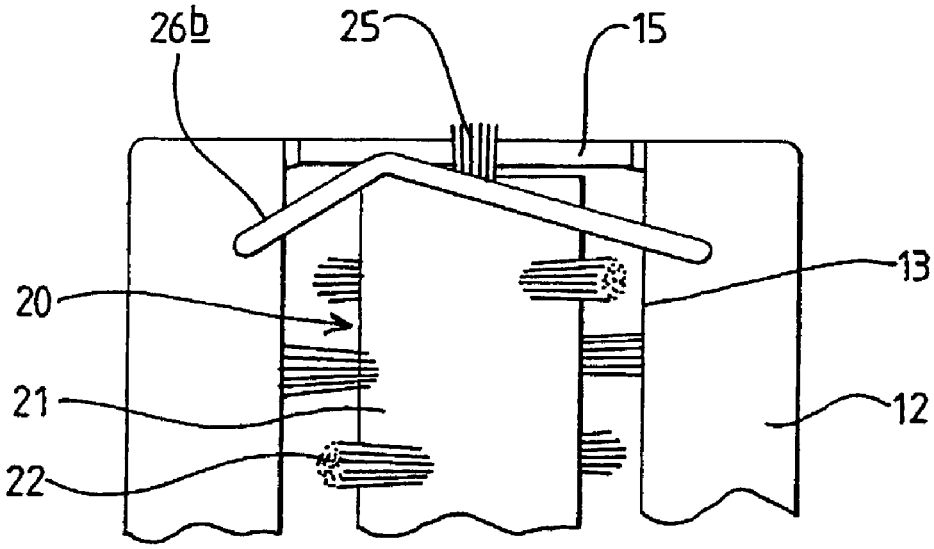
FIG 6

FLOOR SWEEPING APPARATUS

DESCRIPTION OF INVENTION

This invention relates to floor sweeping apparatus of the type having a rotary brush member, which in use is driven to rotate about a generally horizontal axis, the brush member having bristle elements that, as the member rotates, extend during part of their range of movement through an aperture in a base plate of a housing in which the member is rotatably journalled.

Such apparatus may typically form part of a vacuum cleaner, and in that case suction will normally be applied to the housing to draw collected dirt and debris away form the brush member to a suitable collecting chamber which is disposed remotely from the housing. However, the apparatus may also from part of a mechanical floor sweeper of the kind in which the housing itself is provided with a receptacle which serves to collect dirt and debris thrown from the brush member as it rotates.

In such apparatus there has been a long-standing problem in that the sweeping action can only take place within the confines of the housing, and more particularly within the confines of the aperture through which the bristle elements come into contact with the surface being swept.

Conventionally, the brush member is mounted in the housing by means of bearings at the ends thereof, so that each end of the brush member is spaced inwardly from the side face of the housing by a distance sufficient to accommodate the bearing. This effectively makes it impossible for the user to clean fully to the edge of a floor, thus leaving an unswept strip at the junction between the floor or floor covering and the wall or skirting at the base of the wall.

In an attempt to reduce the width of such unswept strip in some cases the brush member has been designed to be supported by bearings that are disposed at positions spaced inwardly of the ends of the brush member and thus disposed away from the side faces of the housing, so that the aperture can extend fully up to the side walls of the housing and bristle elements can correspondingly be provided immediately adjacent to the sides of the housing.

Whilst this represents an improvement in that it reduces the width of the unswept strip, it does not eliminate the unswept strip entirely, and it has also been proposed to provide, at positions adjacent to the sides of the housing, additional rotary brushes which are arranged for rotation about substantially vertical axes so that bristles thereof extend beyond the side faces of the housing during part of their range of movement. However such an arrangement involves substantial additional complication in the construction of the apparatus and is accordingly costly to implement.

According to the present invention there is provided floor sweeping apparatus of the type having a rotary brush member, which in use is driven to rotate about a generally horizontal axis, the brush member having bristle elements that, as the member rotates, extend during part of their range of movement through an aperture in a base plate of a housing in which the rotary brush member is rotatably journalled, wherein there is at least one bristle element, hereinafter called an end-most bristle element, arranged immediately adjacent to each end of said brush member, and wherein a deflector member is provided at each end of the aperture to co-operate with said end-most bristle element at the respective end of the brush member and deflect said end-most bristle element axially outwardly as said end-most bristle element extends through the aperture during the rotation of the brush member.

To facilitate such deflection of the end-most bristle element, the lower edge of a side wall of the housing may be formed with a recess in register with the end of the aperture, and preferably the arrangement is such that the end-most bristle element projects outwardly beyond the end of the aperture.

The deflector member may comprise a guide wire of appropriate form which is arranged to extend across the aperture adjacent the end thereof. Typically the guide wire may be of generally smoothly curved shape so that as, or immediately after, the end-most bristle element first extends through the aperture it contacts the guide wire and is smoothly deflected outwardly to reach maximum deflection at or slightly before its lowest point, and is then allowed to return in a manner controlled by the remainder of the guide wire.

However, it will be appreciated that other arrangements are possible. For example, the guide wire may be formed with a generally straight middle section and curved or angled end portions so that the end-most bristle element is maintained at substantially maximum deflection over most of its travel while extending through the aperture. Moreover, it may be desirable to contour the guide wire such that the end-most bristle does not contact the surface being swept while it is moving outwardly, so as to avoid any tendency to throw dust away from the aperture, but only engages the surface during its return inward movement, thus throwing any dust towards the aperture for collection.

The deflector member may alternatively be formed integrally with the base plate of the housing, and in some cases may not extend across the entire width of the aperture.

If required, the housing may include a guide adjacent the edge of the aperture at which the end-most bristle element passes back into the housing so as positively to return the bristle element axially inwardly.

The rotary brush member may be supported by bearings which engage it externally at positions spaced inwardly from its opposite ends, or by internal bearings carried by stub axles which extend from the side walls of the housing and into end portions of the brush member, the arrangement in either case being such that the brush member is enabled to extend fully up to, but preferably not into direct contact with, the adjacent side wall.

These and other features of the invention will now be described with reference to the accompanying drawings wherein:

FIG. 1 is a fragmentary end view of a first embodiment of floor sweeper in accordance with the invention;

FIG. 2 is a fragmentary underneath plan view of the embodiment of FIG. 1;

Figure 3:
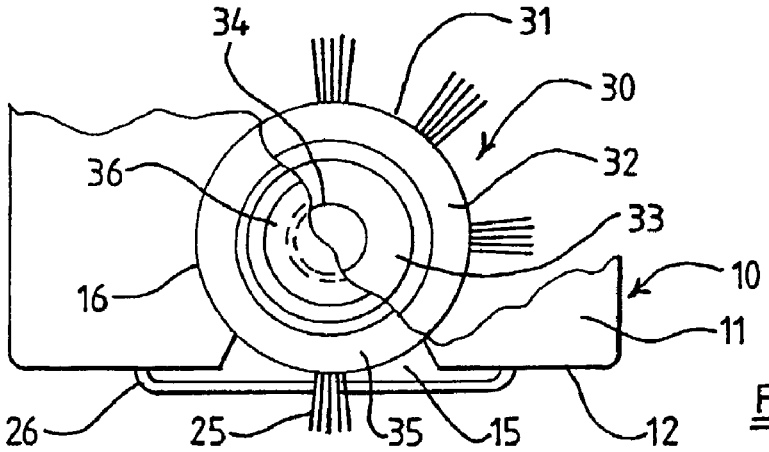
FIG. 3 is a fragmentary end view of a second embodiment of floor sweeper in accordance with the invention.

Referring to FIGS. 1 and 2, a floor sweeper 9 in accordance with the invention includes a housing 10 having side walls 11 (only one of which is illustrated) and at its underside a base plate 12.

A rotary brush member 20 is mounted in the housing 10 for rotation about an axis which, when the sweeper 9 is in use, extends generally horizontally above the surface being cleaned. The member 20 comprises a generally cylindrical body 21 from which spaced bristle elements 22 project radially. In this embodiment, each bristle element 22 comprises a group of bristles arranged in a tuft, but it will be appreciated that other arrangements are possible. The base plate 12 is formed with an aperture 13 which extends fully between the side walls 11 of the housing 10, so as to allow the bristle elements 22 to project through the base plate 12 and into engagement with the surface being cleaned as the brush member 22 is rotated.

In this embodiment, the aperture 13 is bridged at positions inset from the side walls 11 by cross members 14 which carry bearings (not shown) which support the cylindrical body 21 by external engagement with reduced diameter portions 23 thereof. In this way, the cylindrical body 21 can extend fully up to the side walls 11 of the housing, but preferably with sufficient clearance to avoid direct contact with the internal faces thereof.

Figure 4:
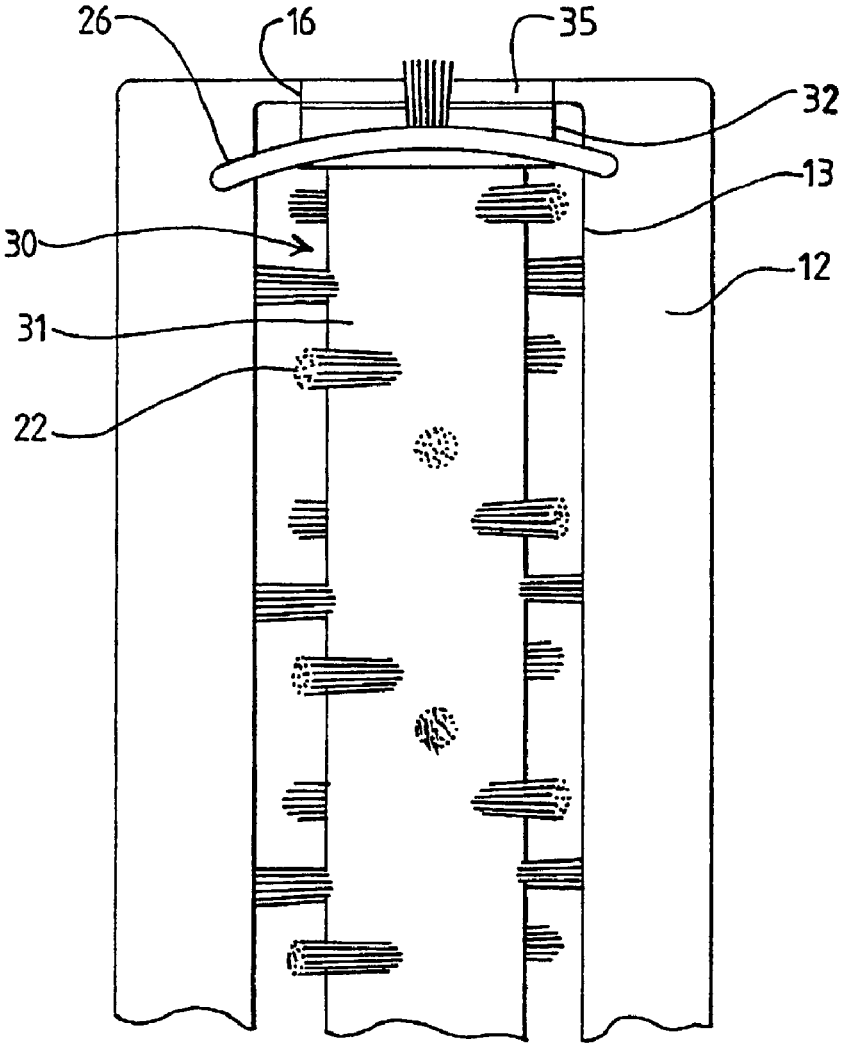
FIG. 4 is a fragmentary underneath plan view of the embodiment of FIG. 3, and FIGS. 5 and 6 are fragmentary end views of alternative forms of deflector member.

However, as shown in FIGS. 3 and 4 (in which like parts carry like references), it is possible as an alternative for the cylindrical body to be supported internally at the ends thereof. As illustrated, a modified brush member 30 includes a cylindrical body 31 which has end portions 32 of relatively increased diameter. The end portions 32 carry bristle elements and the end faces thereof are formed with a respective recess 33 in which is located an outwardly projecting stub axle 34. A respective part-circular recess 16 is formed in the modified side walls 11, and each recess 16 serves to locate an end cap 35 of generally dished shape, so as to enter the recess 33, with a central outwardly extending hollow bearing cup 36 in which the corresponding stub axle 34 is received. In this way the cylindrical body 31 is supported at its end while still being able to extend up to the side walls 11.

In accordance with the invention, at each end of the cylindrical body 21,31 there is provided at least one bristle element 25 which is disposed immediately adjacent to the end of the cylindrical body, for example there may be two such end-most bristle elements at diametrally opposed positions. Deflector members 26 are provided at opposite ends of the brush member 20, 30 to engage said end-most bristle elements 25 and deflect them axially outwardly as they travel through the aperture 13 as the brush member 20, 30 rotates.

In the embodiments illustrated in FIGS. 1 to 4, the deflector member 26 comprises a curved wire which is secured to the underside of the base plate 12, but it will be appreciated that the deflector member could be formed integrally with the base plate if desired.

The arrangement is such that as the end-most bristle element 25 emerges from the aperture 13 it engages the laterally outer surface of the deflector member 26 and is thereby progressively deflected laterally outwardly so as to extend beneath, and preferably beyond, the adjacent side wall 11 as illustrated in FIGS. 2 and 4. To facilitate such deflection, the underside of the side wall 11 may be formed with a recess 15 in register with the end of the aperture 13, as shown most clearly in FIGS. 1 and 3.

With the deflector member 26 as illustrated, the end-most bristle element 25 reaches its position of maximum deflection when it is in its lowest position during its rotary movement and then it is allowed to retract inwardly as the movement continues. During inward movement the end-most bristle element positively throws dust into the aperture 13.

However, the deflector member may take other forms, and for example as illustrated in FIG. 5 the deflector member 26*a* includes a straight central portion which maintains maximum deflection of the end-most bristle element 25 over a substantial portion of its travel across the aperture 13. In a further alternative arrangement as shown in FIG. 6, the deflector member 26*b* is of generally shallow V-shape, with unequal limbs, such that the end-most bristle element is deflected more sharply on its outward movement than on its return movement, with the consequence that it engages the surface only during its inward movement. In this way any tendency to throw dust outwardly is avoided.

Whilst the deflector member preferably extends fully across the width of the aperture 13, it will be understood that if desired it could terminate short of the edge of the aperture 13 at which the end-most bristle element 25 returns into the interior of the housing 10. Also, if desired, the housing could include a deflector element which serves positively to return the end-most bristle element, as may be appropriate in the case of a bristle element consisting of relatively soft fibres with little inherent elasticity.

The bristle elements may comprise groups of relatively rigid bristles which are sufficiently flexible and resilient to follow the shape of the deflector member, or groups of relatively softer and non-resilient fibres, or individual spikes of an appropriately flexible material, for example synthetic rubber.

In the present specification "comprises" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. Floor sweeping apparatus comprising a housing having a base plate, and a rotary brush member rotatably journalled in the housing, wherein the brush member is driven to rotate about a generally horizontal axis, the brush member having bristle elements that, as the member rotates, extend during part of their range of movement through an aperture in the base plate, wherein there is at least one bristle element, hereinafter called an end-most bristle element, arranged immediately adjacent to each end of said brush member, and wherein a deflector member is provided at each end of the aperture to co-operate with said end-most bristle element at the respective end of the brush member to deflect said end-most bristle element outwardly away from the brush member in the axial direction with respect to the generally horizontal axis as said end-most bristle element extends through the aperture during the rotation of the brush member.

2. Floor sweeping apparatus according to claim 1 wherein the housing includes at least one side wall having a lower edge with a recess in register with the aperture.

3. Floor sweeping apparatus according to claim 1 wherein each deflector member comprises a guide wire of appropriate form which is arranged to extend across the aperture adjacent the end thereof.

4. Floor sweeping apparatus according to claim 3 wherein each guide wire is of generally smoothly curved shape so that when or immediately after the respective end-most bristle element first extends through the aperture it contacts the guide wire and is smoothly deflected outwardly to reach maximum deflection at or slightly before its lowest point, and is then allowed to return in a manner controlled by the remainder of the guide wire.

5. Floor sweeping apparatus according to claim 3 wherein each guide wire is formed with a generally straight middle section and curved or angled end portions so that the respective end-most bristle element is maintained at substantially maximum deflection over most of its travel while extending through the aperture.

6. Floor sweeping apparatus according to claim 3 wherein each guide wire is of generally V-shape, with unequal limbs, such that the end-most bristle element is deflected more sharply on its outward movement than on its return movement.

7. Floor sweeping apparatus according to claim 1 wherein the deflector member is formed integrally with the base plate of the housing.

8. Floor sweeping apparatus according to claim 1 wherein the deflector member does not extend across the entire width of the aperture.

9. Floor sweeping apparatus according to claim 1 wherein the deflector member is adapted to positively return the bristle elements axially inwardly into the housing.

10. Floor sweeping apparatus according to claim 1 wherein the rotary brush member is supported by bearings which engage it externally at positions spaced inwardly from its opposite ends.

11. Floor sweeping apparatus according to claim 10, further comprising at least one bridge member that extends across the aperture at a position inset from the side walls, wherein the bridge member supports the bearings.

12. Floor sweeping apparatus according to claim 1, wherein the housing includes one or more side walls having bearing cups, and the rotary brush member includes one or more stub axles having end portions that extend into the bearing cups.

* * * * *